US005475960A

United States Patent [19]

Lindal

[11] Patent Number: 5,475,960

[45] Date of Patent: Dec. 19, 1995

[54] WOODEN FRAME BUILDING CONSTRUCTION

[76] Inventor: Walter Lindal, 1120 8th Ave. Ste. 2201, Seattle, Wash. 98101

[21] Appl. No.: 153,497

[22] Filed: Nov. 17, 1993

Related U.S. Application Data

[63] Continuation of Ser. No. 678,221, Apr. 1, 1991, abandoned.

[51] Int. Cl.[6] ..... E04B 2/00; E04C 2/00

[52] U.S. Cl. ..... 52/478; 52/482; 52/483.1; 52/222; 52/233; 52/536; 52/592.1; 52/745.1; 52/766; 52/779

[58] Field of Search ..... 52/222, 233, 478, 52/479, 480, 481.1, 482, 483.1, 270, 536, 546, 556, 595, 725, 763, 766, 779, 653.1, 745.1, 747, 592.1

[56] References Cited

U.S. PATENT DOCUMENTS

| | | | |
|---|---|---|---|
| 329,513 | 11/1885 | Underwood . | |
| 1,954,242 | 4/1934 | Heppenstall | 403/381 |
| 2,110,787 | 3/1938 | Brandjord | 52/238.1 X |
| 2,126,622 | 8/1938 | Davis | 52/725 X |
| 2,309,453 | 1/1943 | Hasenburg . | |
| 2,497,287 | 2/1950 | Bigard . | |
| 2,801,895 | 8/1957 | Gass | 403/381 X |
| 3,090,086 | 5/1963 | Fata | 403/381 |
| 3,131,442 | 5/1964 | Persson-Melin | 52/222 |
| 3,237,360 | 3/1966 | Mills . | |
| 3,849,960 | 11/1974 | Henry et al. | 52/233 X |
| 4,065,902 | 1/1978 | Lindal | 52/556 X |
| 4,249,355 | 2/1981 | Anderson et al. | 403/381 X |
| 4,292,776 | 10/1981 | MacDonald | 52/556 X |
| 4,305,238 | 12/1981 | Harward et al. | 52/233 |
| 4,481,749 | 3/1987 | Slapsys . | |
| 4,646,506 | 11/1987 | Stirling . | |

FOREIGN PATENT DOCUMENTS

| | | | |
|---|---|---|---|
| 0025284 | 9/1951 | Finland . | |
| 0598025 | 12/1925 | France | 52/481.1 |

*Primary Examiner*—Carl D. Friedman
*Assistant Examiner*—Robert J. Canfield

[57] ABSTRACT

Where a structural frame has elongated spaced parallel framing members therein, longitudinally extending edges of which are substantially coplanar with one another on one side of the frame, boards of wood facing material are superimposed on the edges of the framing members, and interlocked with one another, as well as with the framing members, at male/female joints formed therebetween along parallels to the right angular coordinates of the frame in the plane of the edges. The joints take the form of tongue and groove joints, and in the case of those between the boards and the framing members, the joints are also dovetailed. Certain improvements in sheet metal clad wood facing materials are also shown, as is a process for making boards of sheet metal clad wood facing material from planks of wood which are only partially dried when they are put to use in the process.

22 Claims, 13 Drawing Sheets

WOODEN FRAME BUILDING CONSTRUCTION

RELATED APPLICATION

The present application is a continuation of application Ser. No. 07/678,221, filed Apr. 1, 1991, under the same title, and now abandoned.

FIELD OF INVENTION

This invention relates to certain improved building materials and to certain improved construction techniques for covering one or both sides of a structural frame with facing material. It also relates to the structural panels formed from and by the improved materials and techniques, for example, as part of a wall, roof, floor, deck or the like. More particularly, the invention relates to certain improved materials and techniques of this nature wherein in the structural panels formed therefrom, the frame and facing material are interlocked with one another along parallels to the respective right angular coordinates of the frame. The invention also relates to certain improved sheet metal clad wood facing materials which can be used for this purpose, and to a process for making boards of sheet metal clad wood facing material from planks of wood which are only partially dried when they are put to use in the process.

BACKGROUND ART AND THE INVENTION IN GENERAL

This invention is an extension of the art taught in my U.S. Pat. No. 4,065,902, granted to me Jan. 3, 1978, and relates to further improvements in the same field and is extended to wood siding and flooring, including modifications to both the covering materials and the wood framing members to which they are attached. The problem with my prior invention is that the metal covered wood roofing planks had to be narrow in order that a single nail at one edge could properly fasten the planks to the roof framing. Wide roofing planks could not be adequately nailed and worst of all, such single edge nailing did not provide adequate resistance to shear forces, even when using narrow planks with more nailing.

Also in building construction, other similar problems are apparent that could be solved by an improved method of attaching siding, floor boards and roof boards in a manner where they are adequately attached, resist shear and have no face nailing. There is no use having water proof joints between metal covered roof planks if you are going to pierce the face of the metal by nailing. The same goes, to a lessor extent, to metal covered wood siding. However, metal covered siding, and even wood siding that is not metal covered, such as log siding, can have their appearance ruined by tradesmen who leave hammer marks when they nail. In the case of log siding, which is intended to appear as if the wall is solid logs, vertical rows of hammer marks and nail heads showing every two feet along the wall make it apparent, even to the novice, that it is only wood siding. Face nailing of wood outside decks spoils the deck's appearance and people often trip on spike heads that have worked up. When one observes old houses, it can be noted that hammer marks start face decay and that sweating of nail heads, and the nails themselves, cause rot around the nails to such an extent that sometimes the siding can be pulled off right over the nail heads and often the heads have been rusted off. Even if the nails are sheltered from the weather they cause deterioration in time. They pierce a hole through the siding, and water vapor from inside the house finds escape along the nail causing it to rust and the wood to deteriorate. My invention teaches how to fasten the cladding or facing material, i.e., the roof boards, the siding, the decking and the flooring to their respective rafters, studs and joists without face nailing. My answer is a means to lock the cladding to the rafters, studs or joists with a special dovetail joint. This system eliminates the need for plywood sheathing or braces to resist shear by locking the elements together, like an egg crate, which provides even greater shear resistance when wider planks are used. Both the cladding and the framing members have to be modified to obtain the locked on feature. The cross groove on the cladding has to be undercut on. its sides to form a locking dovetail means. The framing rafters, studs or joists have a similar dovetailed male end that is slit on its end to allow the sides of the male edge to be squeezed together to fit between the outer lips of the cross groove as the cladding is forced on it. The sides will snap back to their original configuration when the male edge of the framing is all the way in, locking the cladding permanently to the framing.

If the roofing planks, or the siding planks, are metal covered, the metal can be formed, as taught in my 1978 invention, to make their edge joints waterproof. Nails can be used, as taught in this invention, if they are hidden in the tongue and grooves. In the woodworking art, tradesmen have always been frustrated by the fact that when a plank is resawn into two boards, the boards will tend to cup on the resawn side. This happens because, no matter how dry we kiln dry the plank on its outside, the heart of the plank will always be wetter. When the plank is split into two boards, the wetter inside face will slowly air dry until it is the same moisture content as the outside. This causes the inside to shrink as it drys, cupping the board in accordance to the difference in dryness. This invention takes advantage of this, otherwise, unfortunate phenomena. Bevelled boards make the best siding, or roof boards. These are always made by diagonally sawing square planks into two bevelled boards. These boards will, in time, cup. If we cover the former outside of the boards with sheet metal, the cupping action will stretch the metal very tightly to the boards. This will allow the use of thinner metal and it will become almost a part of the board, like a very heavy coat of enamel, but will make the board stronger. Using thinner metal will lower the cost and, for instance, will bring the cost of a copper roof to a more affordable level. A new roofing product is born that can be permanently set to its rafters without visible nails, and is even lower cost because the need for plywood is eliminated, and if the roof is copper, it will endure for many decades. Similarly, thinner sheet metal, or aluminum, covering can be used on siding. If the metal has a baked on enamel finish, maintenance costs can be avoided for many decades.

Metal siding and roofing are often disliked because of their tinny sound when touched, or hit, by anything. Even wind makes it rattle and, in time, the sheets tend to work loose and allow the weather in. Hail is particularly noisy. When the metal is thin and stretched tight to the cladding, it does not rattle and even when thumped with the fist, it sounds like a solid timber, as no tinny or metallic sound is heard. The combination of wood and tight metal has a high quality feel and appearance, particularly when the roof is copper and the siding is aluminum with richly colored baked on enamel finish. Both last indefinitely. If the wood is, say, Douglas Fir, which has a hard surface, it will be very hard to dent or pierce the metal through misadventure. Perhaps, best of all, the metal covered siding, or roofing, is fire resistant.

The tendency for wood to cup when two pieces are sawn from a single piece can be turned to more useful purposes. Decking used outdoors can be designed so that its center is always bulged upwards so that it will shed water. Flat decking, or decking that naturally cups, will hold water, which soon leads to deterioration of the finish and to rot. Log siding is made from square boards, which means a lot of the wood is wasted to make the curve. If cupped pieces are used, then less wood needs to be wasted to get the curved log-like appearance, and can be made from thinner wood. Similarly, clam shell casing is curved and the backside is partly plowed out to arch the casing over rough spots and make the edges fit tightly. This wastes wood. Cupped pieces would involve less waste, and can be made from thinner pieces of wood.

Log house walls use a larger volume of wood than framed house walls. Costs are lowered by using tree stems that are green and that are processed no further than debarking and corner notching. However, the weight factor of wet timber reduces the radius of acceptable delivery costs and the logs shrink, settle and check in an unacceptable way. Dead tree stems cut the weight and shrinkage problem, but produce faults like rot and incipient rot and vermin.

It takes months in a kiln and many months in the air to dry freshly cut tree stems. Over the years and, in fact centuries, sawn, dried and planed squared timbers have, in many cases, taken over from round logs. High quality homes, built of cedar, redwood and white oak, as well as lower cost pine, spruce and fir, have appeared in Europe and North America, usually using 4" thick tongue and groove planed, kiln dried timbers.

In the U.S. and Canada, authorities are faulting these timber houses because 4" nominal, or 3½" actual, wall has not enough insulation value. Simply making the walls thicker is just too expensive, especially with the richer quality woods. My invention envisions a wall built of two 2" planks locked to each side of the key like stud, previously disclosed. This produces a cavity to take insulation and hide electric wiring. It is an axiom that two 2" planks, good on one side, are considerably less costly than a 4" plank, good on both sides. They are so much easier to come by out of the tree, and 4" takes four weeks to kiln dry and 2" takes one week. The composite 2" plank and stud wall can be produced at comparable cost to the solid 4" wall. The cost of the wall can be further reduced by using lower cost pine planks on the inside (which are whiter and brighter) than, say, cedar or oak on the outside. In some rooms the inside planks can be left out all together, and very inexpensive gypsum drywall can be used attached directly to the studs. This cavity wall timber house can be built to look exactly like a 4" timber house. I have invented a Danish type notch corner finish, or a Russian style timber corner post can be used to complete the corner. The insulation factor can be raised from R-7 for 3½" of timber wall, to R-26 for an 8½" cavity timber wall (R-11 is required in most areas). No nails will show, and the 2" planks can be curved to simulate a log wall. Square studs that fit tightly between the inside and outside planks and nailed in with hidden nails, as is the siding, can be used to frame doors and windows; also corners and partition junctions, these usually cannot be placed exactly where key locked evenly spaced studs occur.

BRIEF DESCRIPTION OF THE DRAWINGS

The foregoing generalizations will be better understood by reference to the accompanying drawings wherein in FIGS. 12–21 and 25–28 thereof, I have illustrated certain presently preferred embodiments of the improved building materials and construction techniques, and certain structural panels formed therefrom, through the medium of showing how I would form a wall panel from the same.

In the drawings:

FIG. 1 is a cabinet view of a 3×8" plank of wood which is only partially dried and therefore, has a core of moisture laden heartwood at the longitudinally extending axis thereof;

FIG. 2 is a cross section of the plank transverse the longitudinally extending axis thereof;

FIG. 3 is a cabinet view of the plank after pairs of spaced parallel grooves have been formed in the mutually opposing edges of the plank, along parallels to the longitudinally extending axis thereof;

FIG. 4 is a cabinet view of the grooved plank after elongated strips of sheet metal have been superimposed on the mutually opposing sides of the plank, so as to extend lengthwise of the plank along parallels to the longitudinally extending axis thereof, and the longitudinally extending edge portions of the strips have been wrapped about the corners of the plank to enclose the corners in sheet metal;

FIG. 5 is a cross section of the grooved, sheet metal covered plank seen in FIG. 4, transverse the longitudinally extending axis of the plank;

FIG. 6 is a cabinet view of the grooved, sheet metal covered plank seen in FIGS. 4 and 5 after the plank has been subdivided in a diagonal plane thereof which extends through the moisture-laden heartwood core of the plank along parallels to the longitudinally axis thereof and intersects the bottoms of those diagonally opposing grooves in the mutually opposing edges of the plank which are relatively adjacent the mutually opposing sides thereof;

FIG. 7 is a cross section of the subdivided, grooved, sheet metal covered plank seen in FIG. 6, transverse the longitudinally extending axis of the plank;

FIG. 8 is a cabinet view of one of the two beveled sheet metal clad boards which are formed by the subdivision of the plank seen in FIGS. 4 and 5;

FIG. 9 is a cross section of the one board, transverse the longitudinally extending axis thereof;

FIG. 10 is a cabinet view of the one board after it has been separated from the other board, and the moisture-laden heartwood therein has undergone drying at the beveled operatively inwardly oriented side of the board;

FIG. 11 is a cross section of the board seen in FIG. 10 transverse the longitudinally extending axis thereof;

FIG. 22 is a cross section of a grooved 4×8" plank of wood, transverse the longitudinally extending axis thereof, for forming plain uncovered boards of wood facing material from planks of wood which are only partially dried when they are put to use in the process of forming the boards;

FIG. 23 is a further cross section of the plank seen in FIG. 22, after the plank has been subdivided in a horizontal plane thereof to form the boards;

FIG. 24 is a cross section of one board after the exposed moisture-laden heartwood of the board has undergone drying at the relatively inwardly oriented side of the board;

BEST MODE FOR CARRYING OUT THE INVENTION

Figure 1:
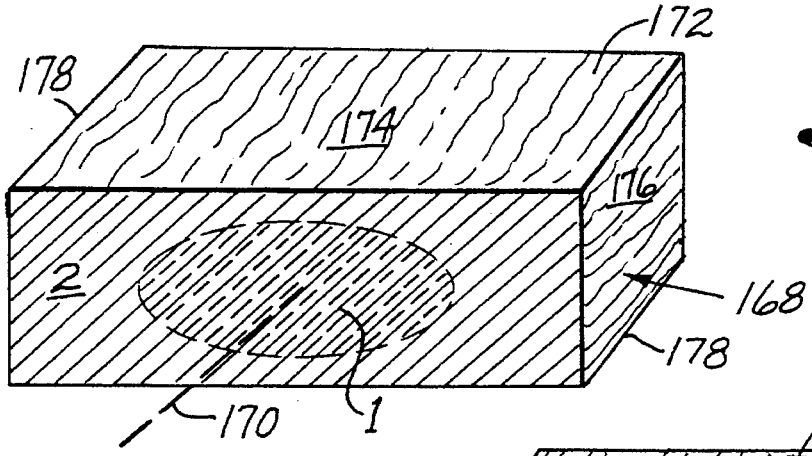
In FIGS. 1–11 and 22–24, I have illustrated a process for making boards of wood facing material, and in particular, boards of sheet metal clad wood facing material from planks of wood which are only partially dried when they are put to use in the process.
Figure 3:
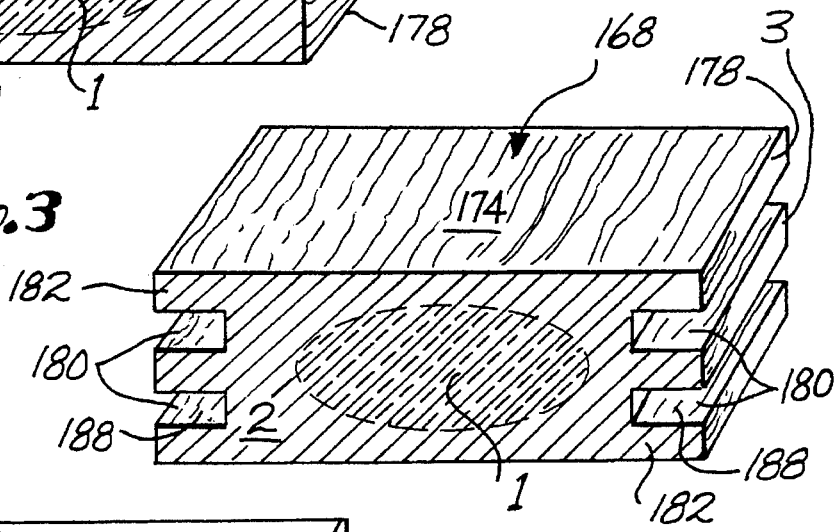
Figure 4:
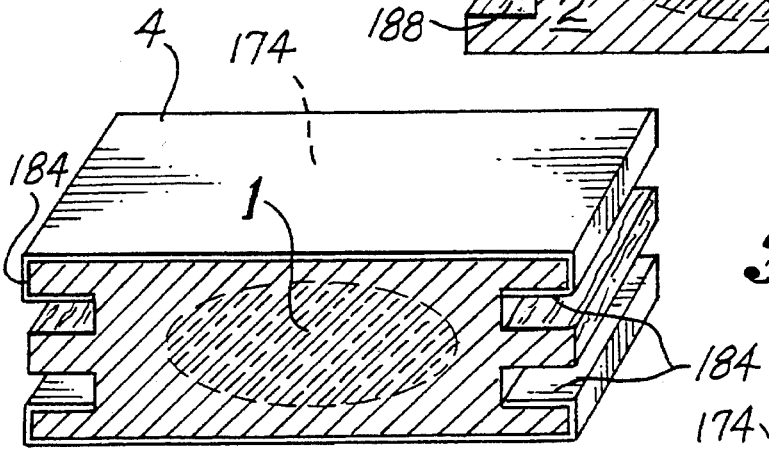
Figure 6:
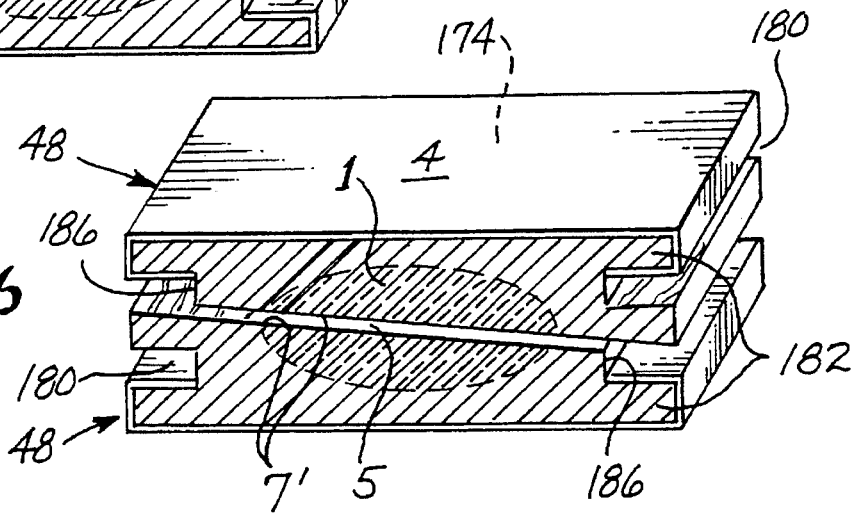

Referring to the drawings, and initially to FIGS. 12–18 in particular, it will be seen that although only a segment of it is shown, the illustrated wall panel 82 comprises a plurality of elongated spaced parallel studs 9 of wood which are arranged upright on vertical axes 84 and interconnected with one another at the tops and bottoms thereof (not shown) so as to form an integral frame 86 that is covered in turn with boards 87 of wood facing material at one side thereof, such as at the relatively outwardly oriented side 88 thereof, to form the panel. In the panel, the longitudinally extending edges 90 of the studs on the outwardly oriented side 88 of the frame are substantially coplanar with one another, and the boards 87 of wood facing material are superimposed on the edges 90 of the studs, and interlocked with one another, as well as with the studs, at male/female joints 92 and 94, respectively, formed therebetween along parallels to the horizontal and vertical coordinates of the panel in the plane of the edges 90. The joints 92 and 94 take the form of tongue and groove joints, and in the case of those between the boards and the studs, the joints 94 are also dovetailed, as shall be explained.

More specifically, the studs 9 comprise elongated pieces 96 of wood having axes 84 extending longitudinally thereof, pairs of spaced corners 98 that extend longitudinally of the pieces parallel to the axes 84 thereof, and are disposed in the plane of the frame 86 at the outwardly oriented side 88 thereof, edges 90 that extend longitudinally of the pieces parallel to the axes 84 thereof in the spaces between corners 98, and mutually opposing sides 100 that extend longitudinally of the pieces parallel to the axes 84 thereof transverse the edges 90, and that coterminate with the edges 90 at the respective corners 98 thereof to define longitudinally extending edge portions 102 of the pieces. The boards 87 of wood facing material comprise elongated pieces 104 of wood having axes 106 extending longitudinally thereof, peripheral outlines 108 extending about the axes, and generally quadrilateral cross sections 110 in planes transverse the axes 106. The cross sections 110 of the pieces 104 define pairs of mutually opposing sides 7 and edges 112 and 113 and corners 114 therebetween on the peripheral outlines 108 of the pieces, and in the panel, the sides 7' and 7" of the pieces 104 are oriented relatively inwardly and outwardly of the frame 86 at the relatively outwardly oriented side 88 thereof. One of the edges of each piece, 112, has a rabbet 116 therein which extends along a parallel to the axis 106 of the piece at the corner 114 thereof lying between the one edge 112 and the relatively inwardly oriented side 7' of the piece, to form a projecting tongue 118 on the one edge between the relatively outwardly oriented side 7" of the piece and the rabbet 116. The other edge 113 of the piece has a first groove 120 therein which extends along a parallel to the axis 106 of the piece and is adapted to receive the tongue 118 of a corresponding second piece of the facing material when it is juxtaposed as shown, edge to edge with the aforedescribed first piece of facing material at the one and other edges 112 and 113 thereof, respectively. The first groove 120 has sidewalls 122 and 124 therein oriented relatively inwardly and outwardly of the frame, respectively, and a bottom 126 extending therebetween. The tongue 118 has a surface 128 adjacent the rabbet 116 which is oriented relatively inwardly of the frame 86, and extends substantially coplanar with the relatively outwardly oriented sidewall 124 of the first groove 120.

The relatively inwardly oriented side 7' of each piece 104 of facing material has second grooves 6 therein which extend transverse the axis 106 of the piece at intervals corresponding to the spacing between the studs 9 of the frame 86, and which are adapted to receive the longitudinally extending edge portions 102 of the studs to form the male/female joints 94 between the piece and the studs, when the piece is superimposed on the outwardly oriented side 88 of the frame transverse the edges 90 of the studs as shown. In addition, the second grooves 6 have bottoms 130 therein which are substantially coplanar with the relatively outwardly oriented sidewall 124 of the first groove 120 and the surface 128 of the tongue 118, so that when two or more pieces 104 of facing material are superimposed on the outwardly oriented side 88 of the frame 86 as shown, and the bottoms 130 of the second grooves 6 in the pieces are abutted against the edges 90 of the studs 9 as shown, the tongue 118 of each piece is insertable in the first groove 120 of the next adjacent piece, to form the male/female joints 92 between the pieces when the pieces are abutted against one another at the one and other edges 112 and 113 thereof, respectively, to form butt joints therebetween as shown.

Furthermore, in the panel, the second grooves 6 in the pieces 104 of wood facing material have mutually opposing sidewalls 132 therein, and the sidewalls 132 in turn have relatively inturned lips 134 thereon which project relatively toward one another adjacent the relatively inwardly oriented sides 7' of the pieces of facing material, but are spaced apart from one another by slots 136 that open into the inwardly oriented sides 7' of the pieces and are adapted to render the pieces 104 engageable about the edge portions 102 of the studs 9 in the male/female joints 94 formed therebetween. The edges 90 of the studs, meanwhile, have slit-like grooves 12 therein which extend longitudinally of the studs to subdivide the edge portions 102 thereof into at least pairs of longitudinally extending edge sections 138 which are adapted to be resiliently deflected relatively toward one another transverse the axes 84 of the studs when a pincer effect is applied to the edge portions 102 of the studs. Additionally, the sides 100 of the studs have laterally outwardly oriented recesses 8 therein which are mutually opposed to one another in dimensional planes of the studs that extend parallel to the edges 90 thereof and traverse the grooves 12 in the edges. Because of the grooves 12 in the edges 90 of the studs, the edge portions 102 of the studs are adapted to be forcibly inserted in the grooves 6 in the sides 7' of the pieces 104 of facing material through the slots 136 between the relatively inturned lips 134 thereof when the pieces of facing material are superimposed on the relatively outwardly oriented side 88 of the frame 86 and the relatively inturned lips 134 on the sidewalls 132 of the grooves 6 in the facing material apply a pincer effect to the respective edge portions 102 of the studs to pinch together the edge sections 138 of the respective edge portions and enable the grooves 6 to engage about the edge portions. Thereafter, when the lips 134 of the grooves 6 register with the recesses 8 in the sides 100 of the studs, the respective pairs of edge sections 138 of the studs snap engage in the grooves 6 behind the lips 134 to form dovetail joints 94 between the pieces 104 of facing material and the studs at the plane of the frame and along parallels to the vertical coordinate of the wall.

Figure 19:
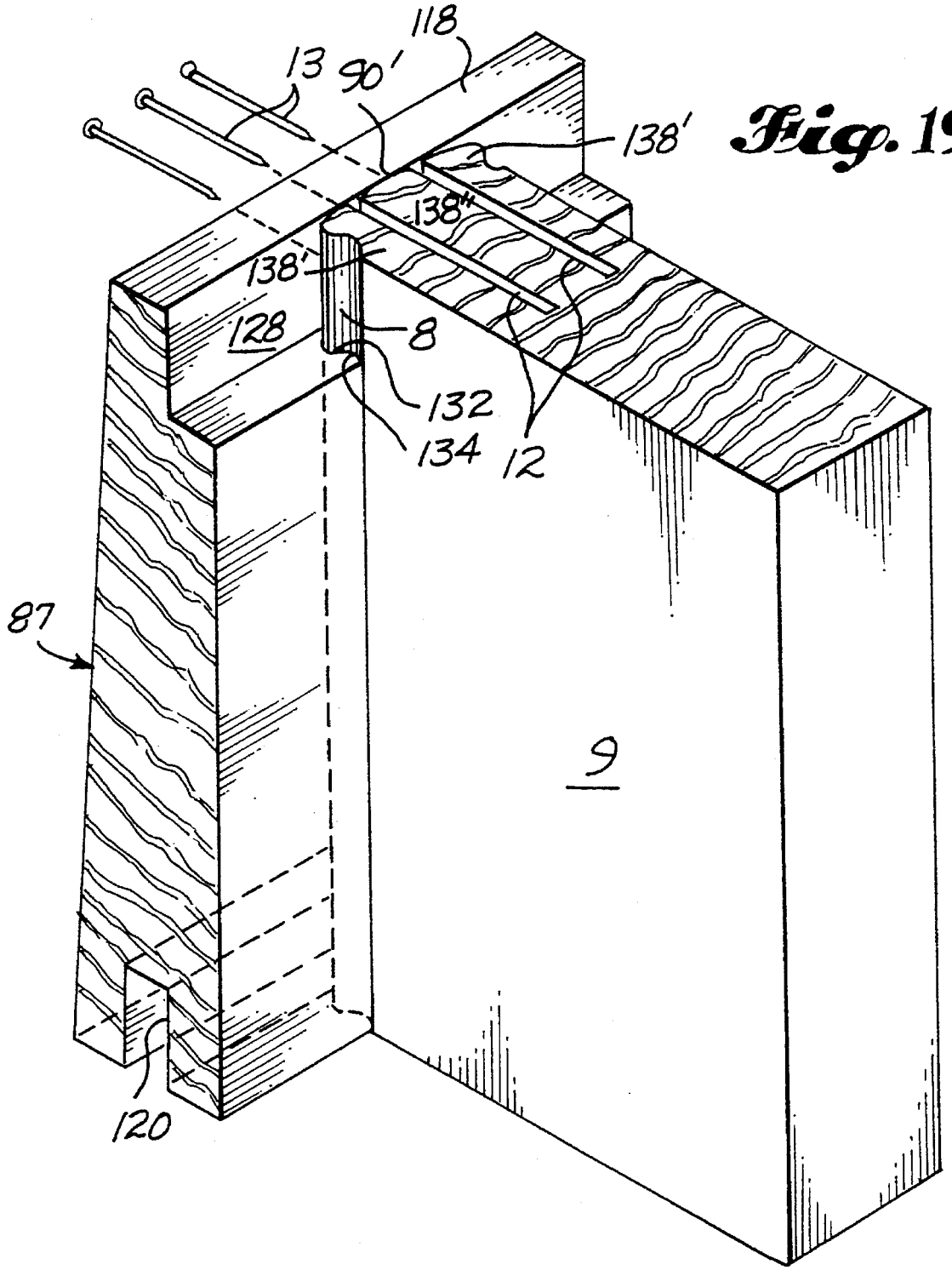
FIG. 19 is a part perspective view of a wall panel segment when a somewhat different framing material has been used in making modified joints between the boards and framing members.
Figure 20:
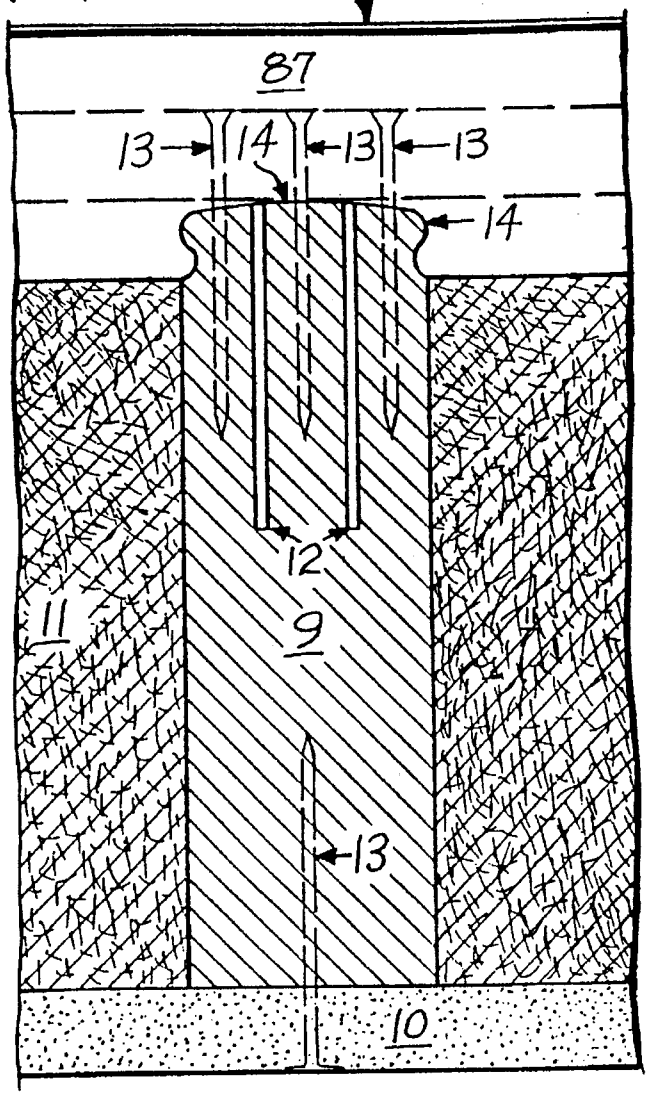
FIG. 20 is an enlarged part cross sectional view of the joint seen in FIG. 19, horizontally thereof and after the nails shown therein have been added to the same; insulation has been added to the recesses between framing members; and drywall has been added to the opposing side of the panel.

In FIGS. 19 and 20, the edges 90' of the studs 9 have pairs of spaced parallel slit-like grooves 12 therein which extend longitudinally of the studs to subdivide the edge portions thereof into three edge sections 138 apiece, the relatively outermost edge sections 138' of which are resiliently deflectable relatively toward the intermediate edge sections 138" at the grooves 12 therebetween when pinched together by the pincer action of the relatively inturned lips 134 on the sidewalls 132 of the grooves 6 in the inwardly oriented sides 7' of the pieces 104 of facing material.

When each piece 104 of facing material has been engaged on the frame 86 so that the bottoms 130 of the second grooves 6 in the piece are abutted against the edges 90 of the studs of the frame, and vice versa, nails 13 are commonly driven through the tongue 118 of the piece at the sites at which the tongue overlies the end edges 140 (FIG. 13) of the edge sections 138 of the studs to further secure the piece of facing material to the frame. Subsequently, when a second piece 104 of facing material is abutted edge to edge with the first piece of facing material, the two pieces of material are readily interlocked with one another at the tongue 118 and first groove 120 of the same, respectively, by engaging the first groove 120 of the second piece about the tongue 118 of the first piece as the second piece is snap engaged on the longitudinally extending edge portions 102 of the studs in the manner of FIGS. 13 and 19. Glue 14 may also be employed between the studs 9 and pieces 104 at the joints 94 formed therebetween, as seen in FIGS. 18 and 20.

Figure 21:
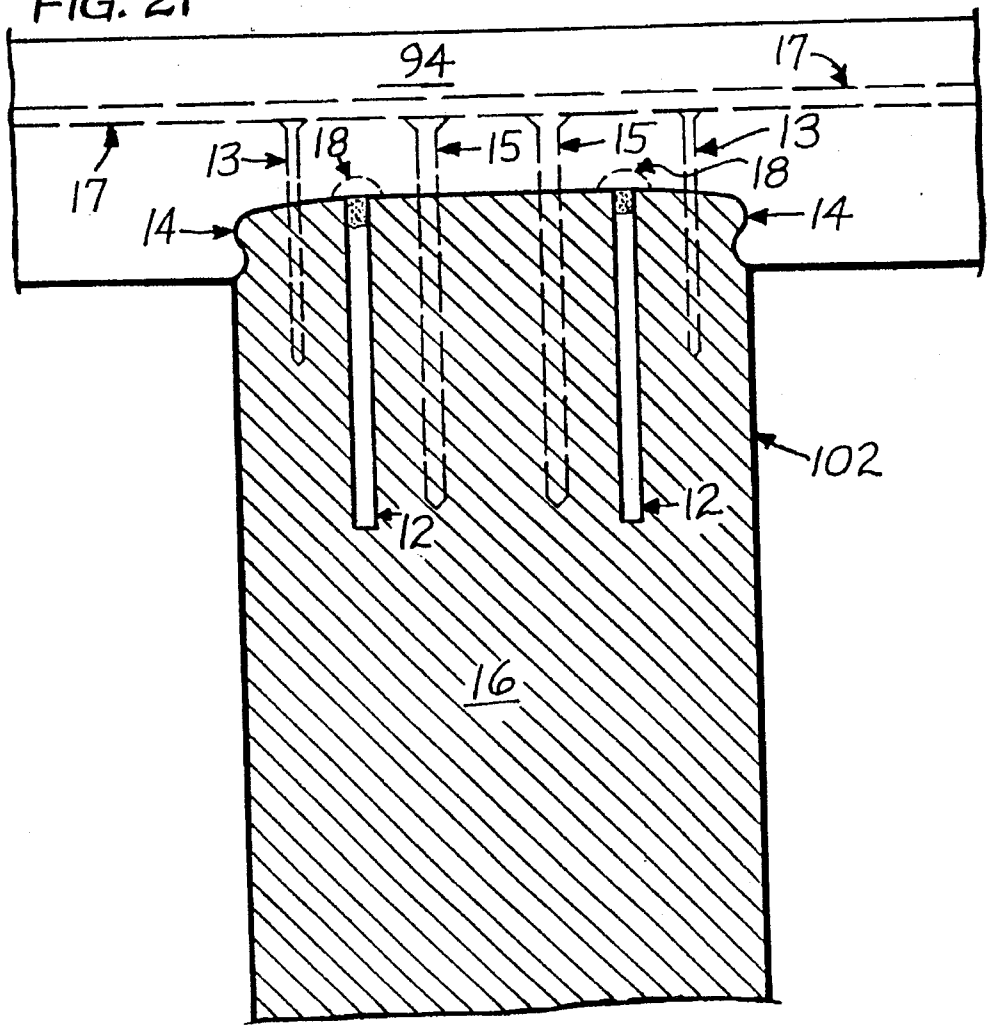
FIG. 21 is an enlarged part cross sectional view of the joint seen in FIGS. 20 and 21, when the joint has been rotated ninety degrees and enlarged for use in a horizontal plane and beads of caulking material have been incorporated in the joint to safeguard it against water penetration.

When the framing members take the form of joists 16 which are horizontally disposed, such as for decking 19, as in FIG. 21, beads 18 of caulking material may be included in the joints 94 at the mouths of the grooves 12 in the edge portions 102 of the joists, to prevent water from collecting in the grooves below the joints.

Figure 15:
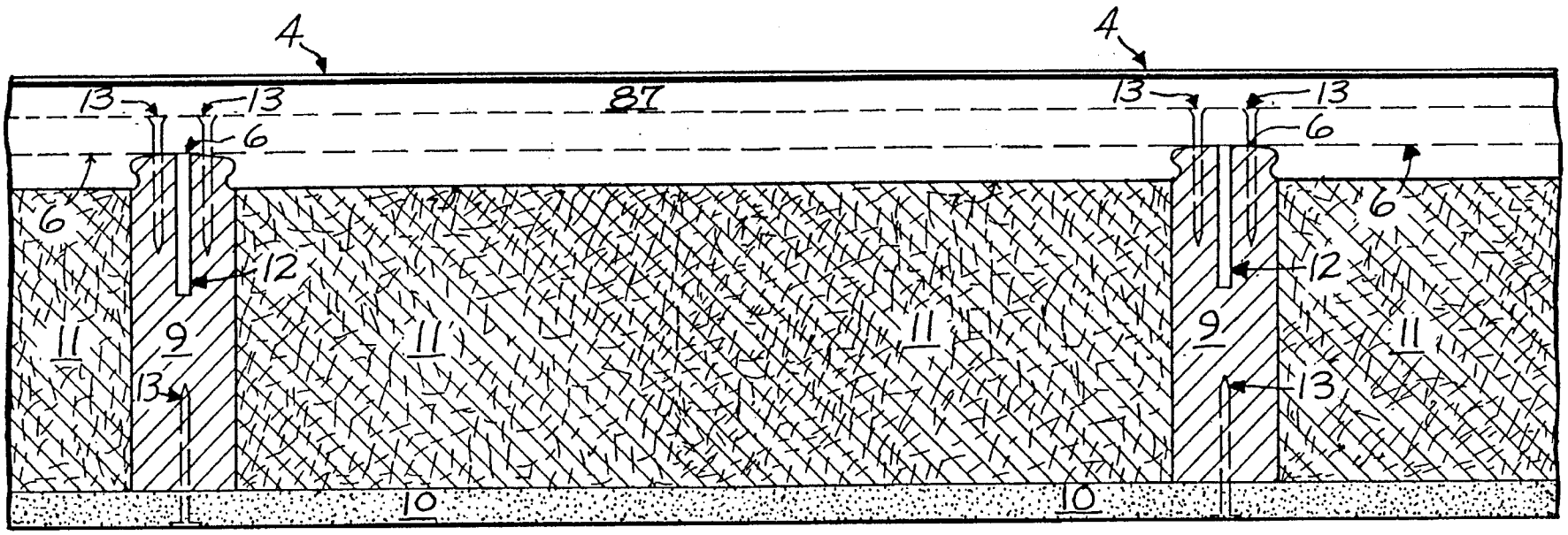
FIG. 15 is a part cross sectional view of the wall panel segment, taken in a horizontal plane of the panel and showing the addition of insulative material to the recesses of the panel between the framing members thereof.
Figure 18:
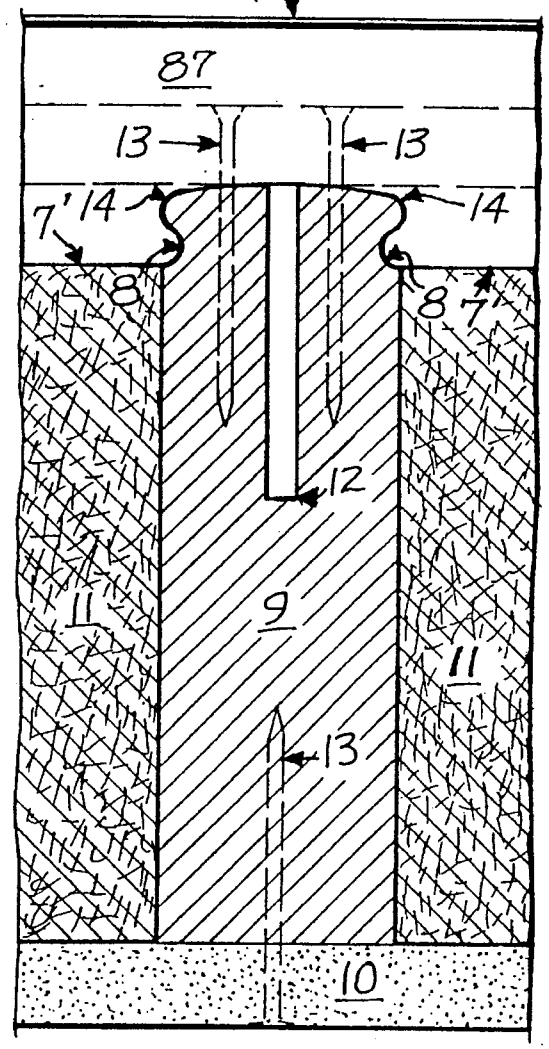
FIG. 18 is a third enlarged part cross sectional view of the joint, horizontally thereof, after the joint has been made with nails included therein; insulation has been added to the recesses between framing members; and drywall has been added to the opposing side of the panel.
Figure 17:
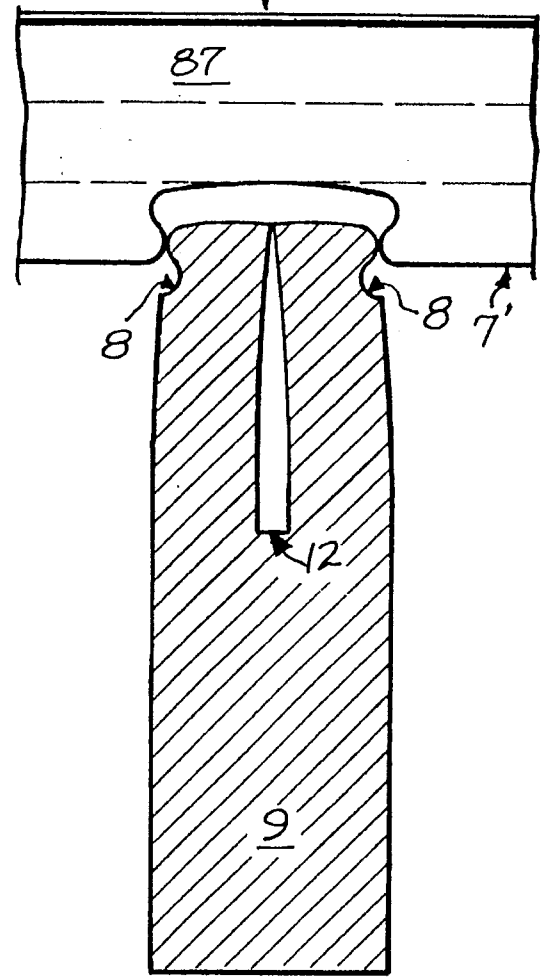
FIG. 17 is a second enlarged part cross sectional view of the joint, horizontally thereof, and at the time when the joint is actually being made in the execution of my improved technique.
Figure 16:
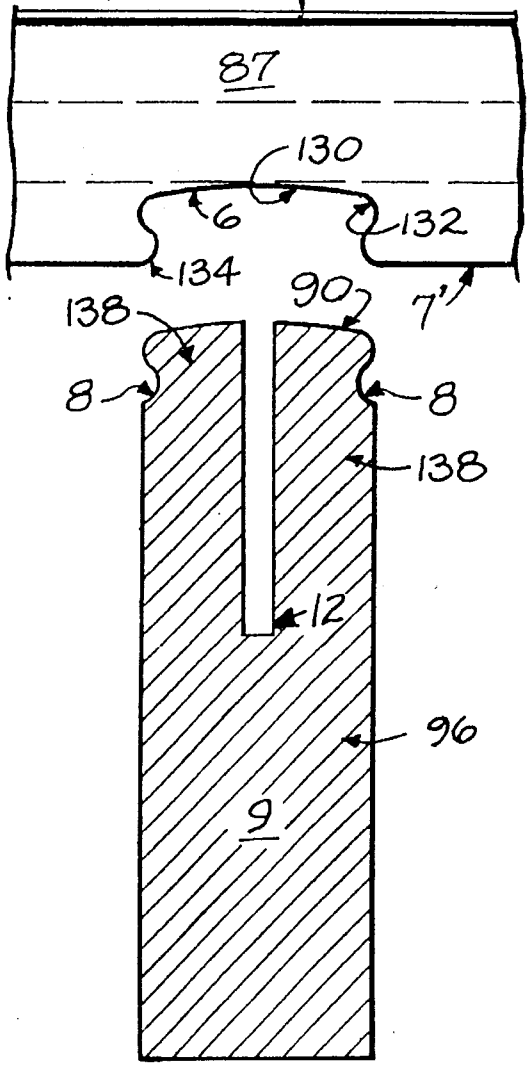
FIG. 16 is an enlarged part cross sectional view of a joint to be made in the panel between the boards and framing members, horizontally thereof, when they are interlocked with one another along parallels to the vertical coordinate of the panel.

When the relatively outwardly oriented side 88 of a frame has been covered with facing material, fiberglass insulation 11 may be added to the frame at the recesses between pairs of framing members, as in FIGS. 15, 18 and 20, and then a drywall material 10 may be superimposed on and nailed to the opposing relatively inwardly oriented side 142 of the framer using nails 13, as in FIGS. 14, 15, 18 and 20.

Figure 26:
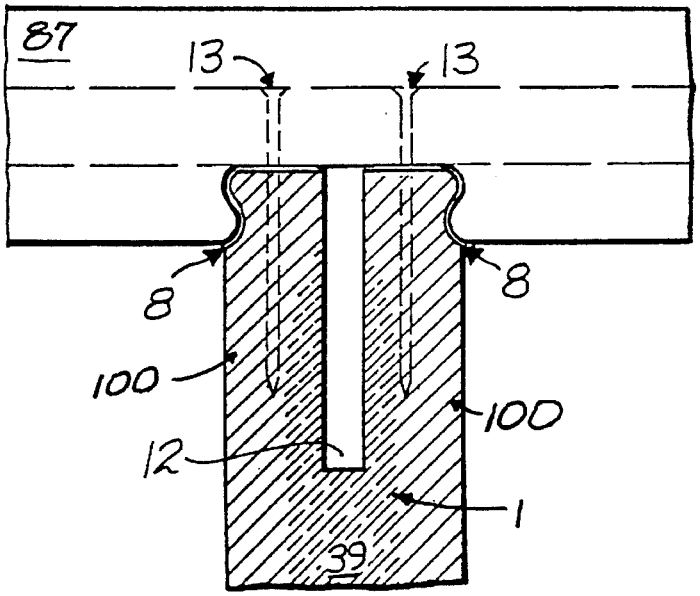
FIG. 26 is a part cross sectional view of a wall panel segment, horizontally thereof, and at the site of a joint between the facing and framing members therein, when the framing members are only partially dried at the longitudinally extending edge portions thereof.
Figure 27:
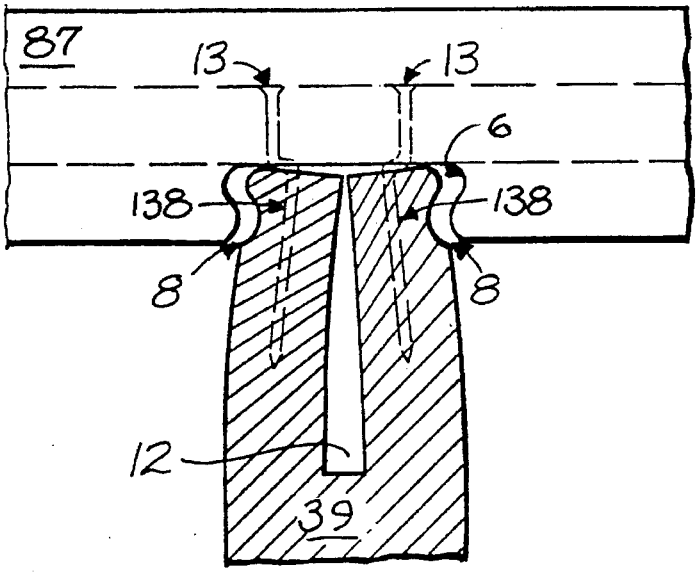
FIG. 27 is a second part cross sectional view of the joint of the wall panel segment seen in FIG. 26 and illustrating a problem which may arise when the longitudinally extending edge portions of the framing material undergo drying.
Figure 28:
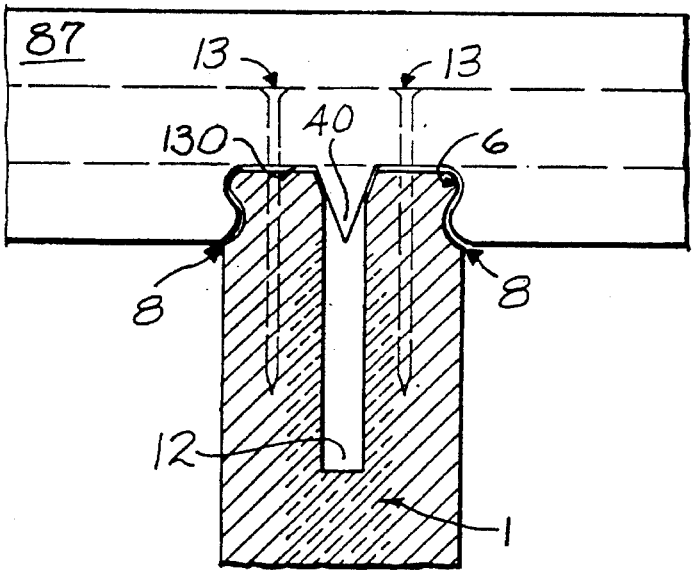
FIG. 28 is a third part cross sectional view of the joint of the wall panel segment seen in FIG. 26 when a rib of facing material has been included in the joint to counteract the problem shown in FIG. 27.

FIGS. 26 and 27 illustrate a problem which can arise when the framing members 39 are only partially dried and have cores 1 of moisture laden heartwood at the interiors thereof, which are disposed between the sides 100 of the members and across those dimensional planes of the members which traverse the grooves 12 in the edges 90 thereof. As the heartwood material dries, there is a risk that the edge sections 138 of the framing members will redeflect relatively toward one another in the grooves 12 therebetween, as seen in FIG. 27. Therefore, to counteract this possibility, triangularly cross sectioned ribs 40 of wood material are left upstanding on the bottoms 130 of the second grooves 6 in the boards 87 of facing material, to be interposed in the grooves 12 between the pairs of edge sections 138 of the respective framing members, as seen in FIG. 28.

Figure 22:
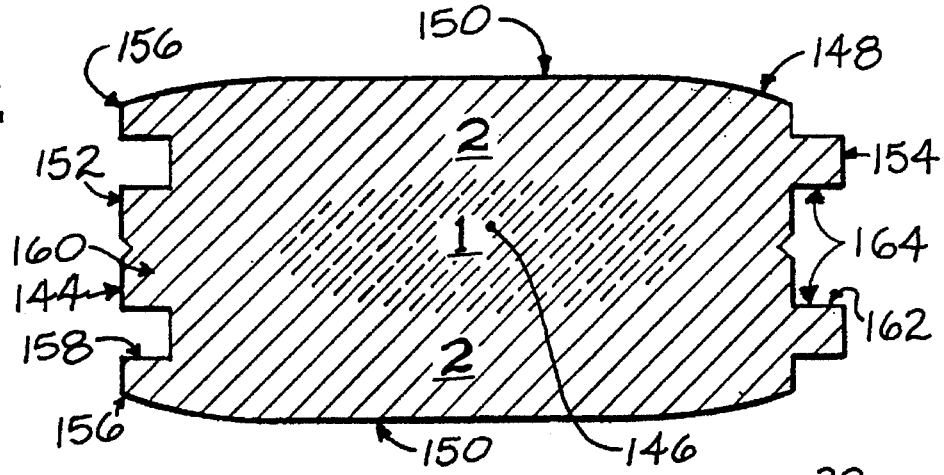
Figure 23:
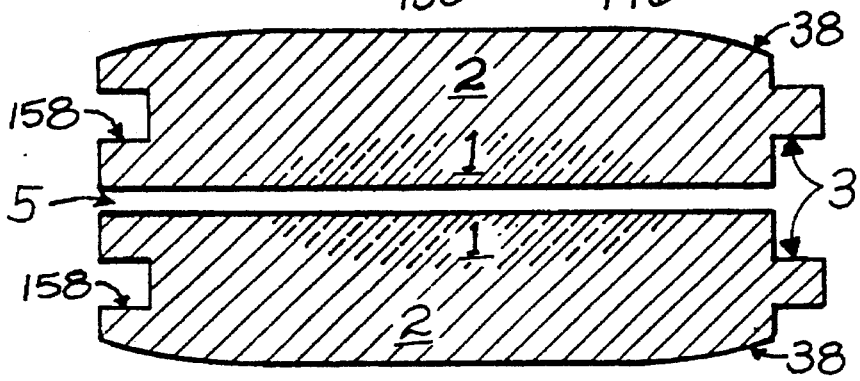
Figure 24:
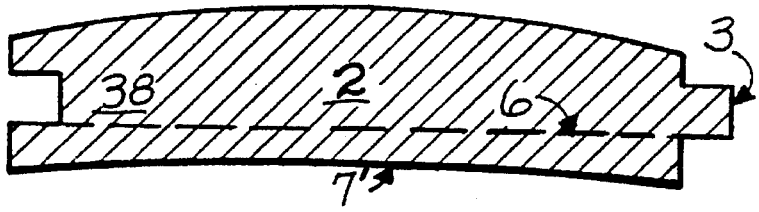
Figure 25:
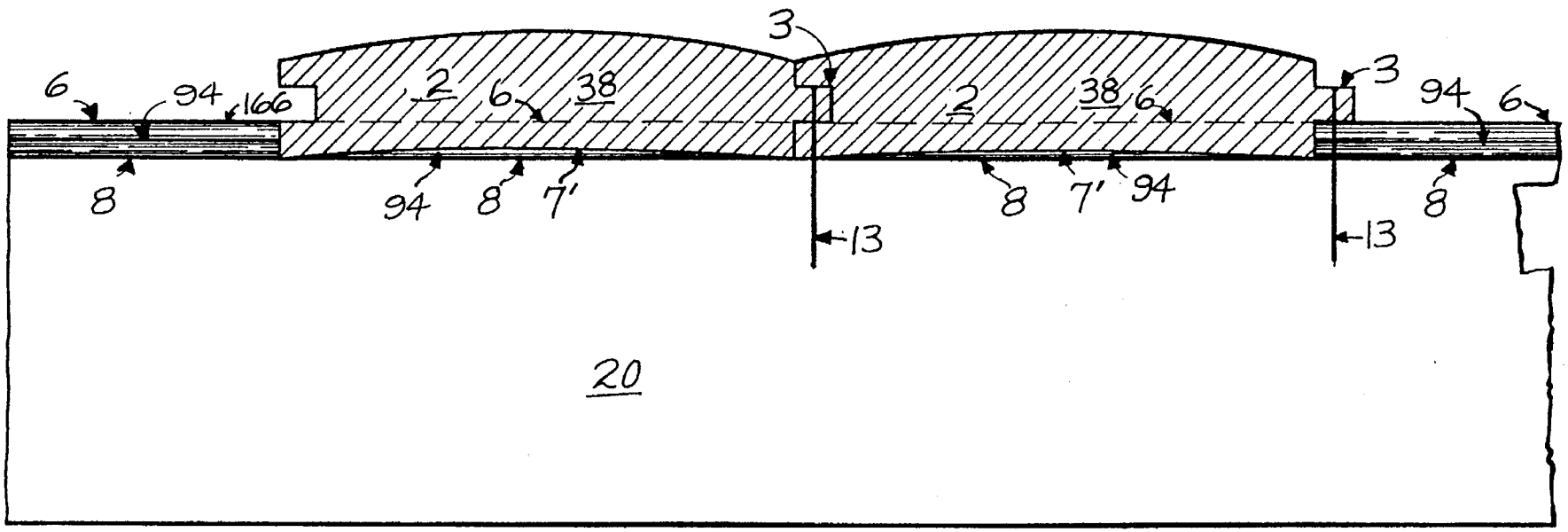
FIG. 25 is a vertical cross section of a wall panel segment employing the boards of FIG. 24 as the facing material thereof.

Referring now to FIGS. 22–25, and initially to FIGS. 22–24, it will be seen that in making pieces of facing material for covering the frame, I often fashion them from planks 144 of partially dried wood having axes 146 extending longitudinally thereoff peripheral outlines 148 about the axes 146 thereof, and generally quadrilateral cross sections transverse the axes 146 which define pairs of mutually opposing sides 150 and edges 152 and 154 and corners 156 therebetween at the outlines 148 of the planks. In addition, one edge 152 of each plank has a pair of spaced parallel grooves 158 therein which extend along parallels to the axis 146 of the plank and cooperate with one another in defining a longitudinally extending intermediate land 160 of facing material in the space between the grooves 158 at the one edge 152 of the plank. The other edge 154 of the plank has a single groove 162 therein that extends along a parallel to the axis 146 of the plank and cooperates with the sides 150 of the plank in defining longitudinally extending tongues 164 on the outline 148 of the plank at the adjacent corners 156 thereof. The end edges of the tongues, however, have rabbets 166 therein that extend along parallels to the axis of the plank at those corners of the tongues 164 lying between the edge 154 and the mutually opposing sides 150 of the plank. Additionally, due to the partially dried condition thereof, the plank also has a core 1 of relatively moisture laden heartwood extending longitudinally thereof at the axis 146 of the plank, and a sheath 2 of relatively dry peripheral wood extending longitudinally thereof about the hardwood core 1 thereof, but within the outline 148 of the plank.

In the process of making the pieces of facing material, I subdivide the planks 144 in planes 5 which extend through the heartwood cores 1 thereof along parallels to the axes 146 of the planks, and divide the lands 160 and grooves 162 of the planks so that pairs of elongated boards 38 of the wood material having longitudinally extending tongues 3 and grooves 158 on the opposing edges thereof, are formed from the respective planks, and the mutually opposing inwardly oriented sides 7' of which are subject to shrinkage along parallels to the plane 5 of subdivision between the boards 38 when the boards are relatively separated from one another at the plane to expose the moisture laden heartwood 1 to drying at the operatively inwardly oriented sides 7' of the boards. This in turn produces a somewhat crescent-shaped cross section in the boards 38, transverse the longitudinally extending axes thereof, so that when the boards 38 are equipped with cross grooves 6 and are engaged on the relatively outwardly oriented side 166 of a frame 20, and interlocked with one another and the frame, using dovetailed joints 94 at the frame, as in FIG. 25, they present a rounded or log-sided appearance to the viewer.

Figure 2:
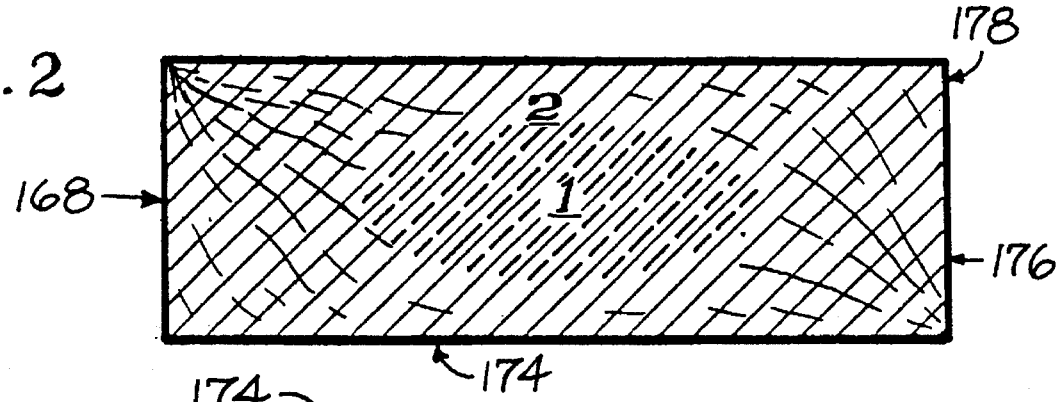
Figure 5:
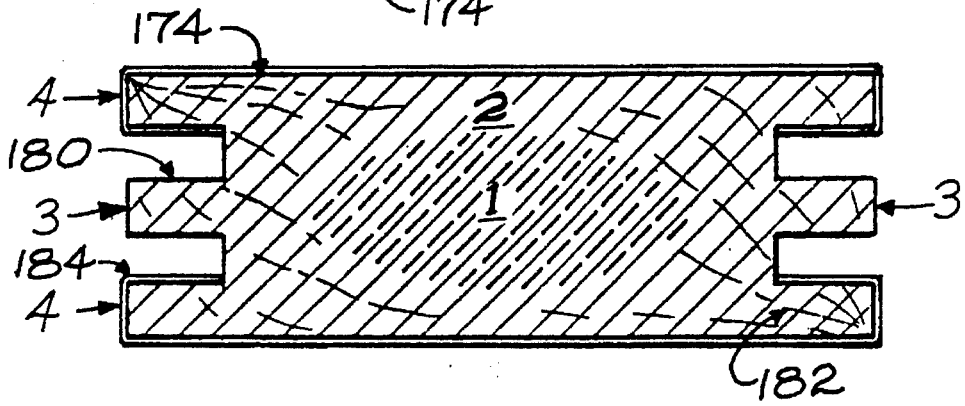
Figure 7:
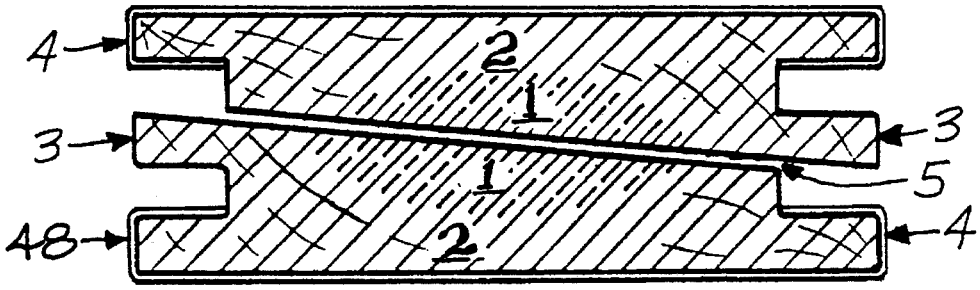
Figure 9:
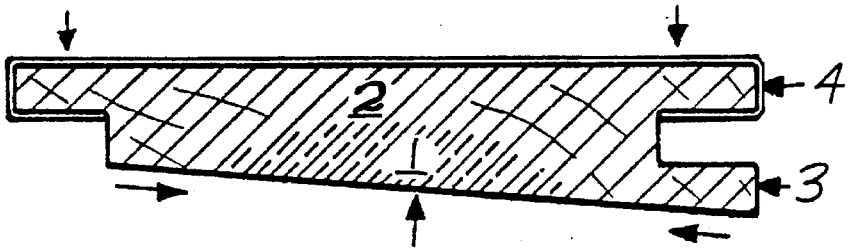
Figure 11:
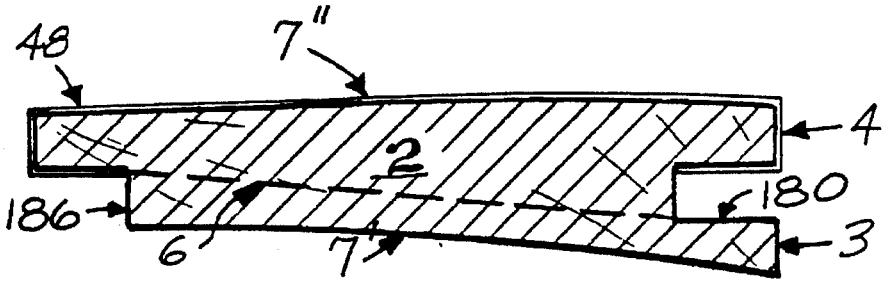
Figure 8:
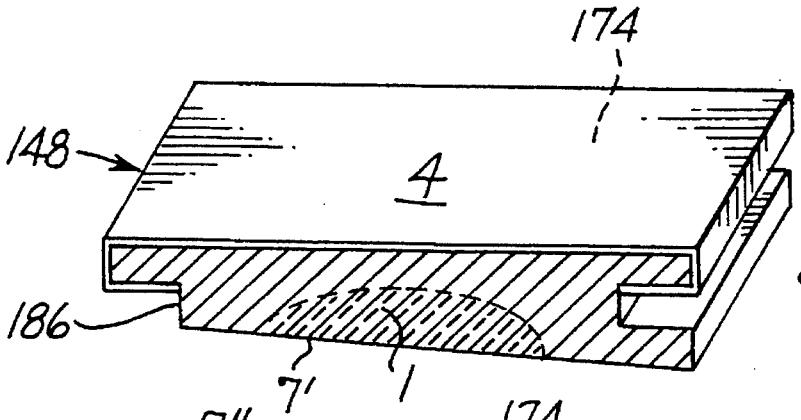
Figure 10:
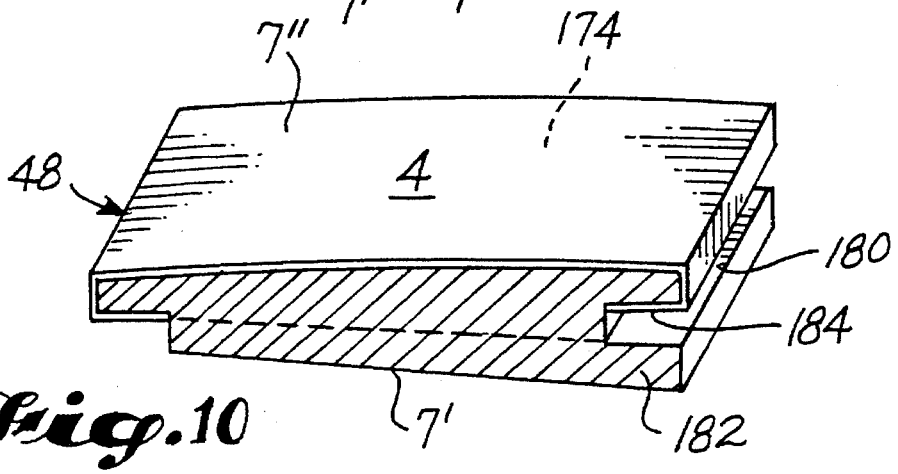
Figure 12:
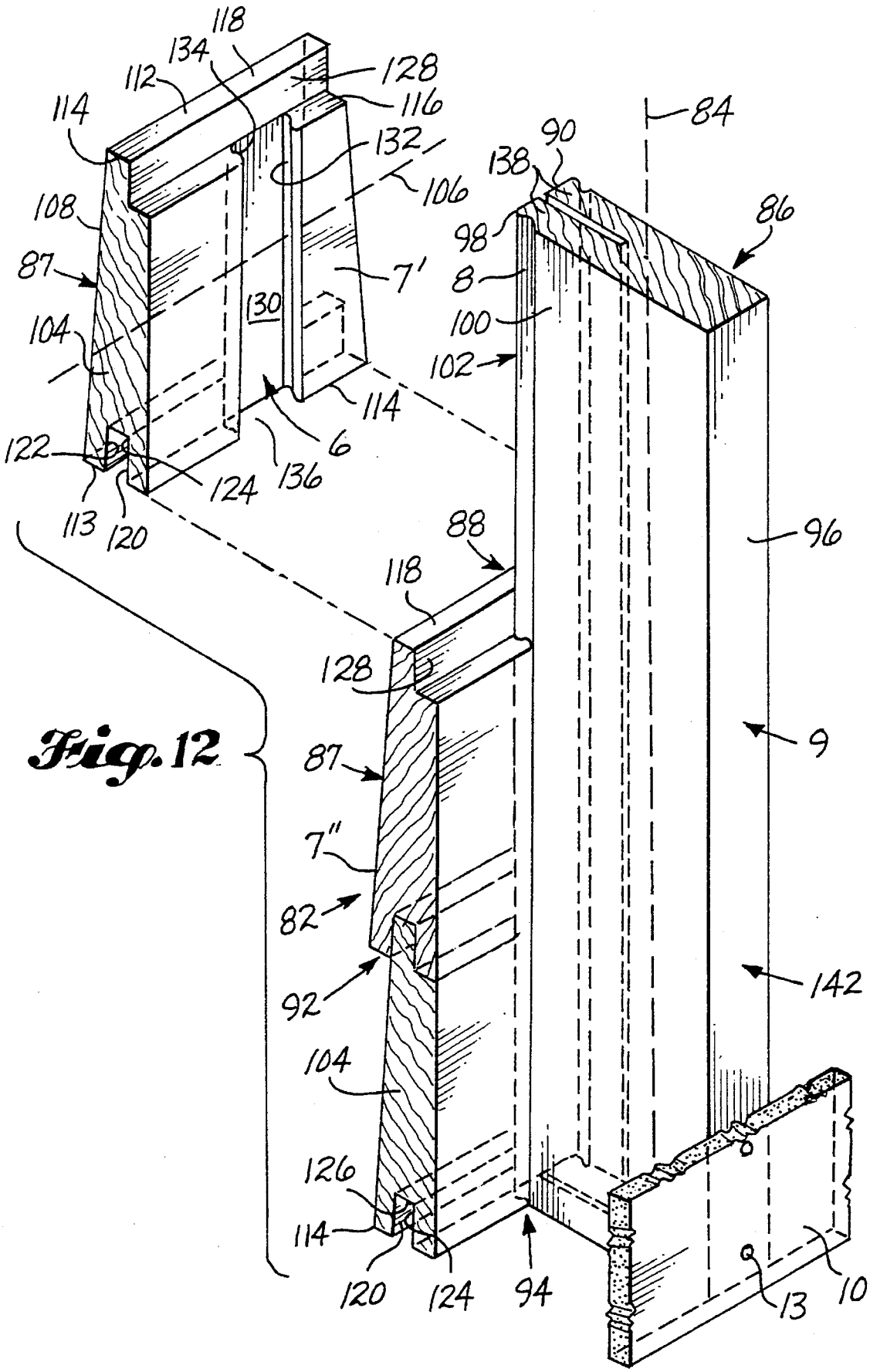
FIG. 12 is a partially exploded, part perspective view of a segment of a drywall-sheathed wall panel formed from and by one embodiment of the improved material and technique of my invention, using a frame comprised of elongated spaced parallel framing members, and covering it with boards of sheet metal clad wood facing material derived by the process of FIGS. 1–11, although for ease of illustration, the sheet metal cladding has been omitted from the boards.
Figure 13:
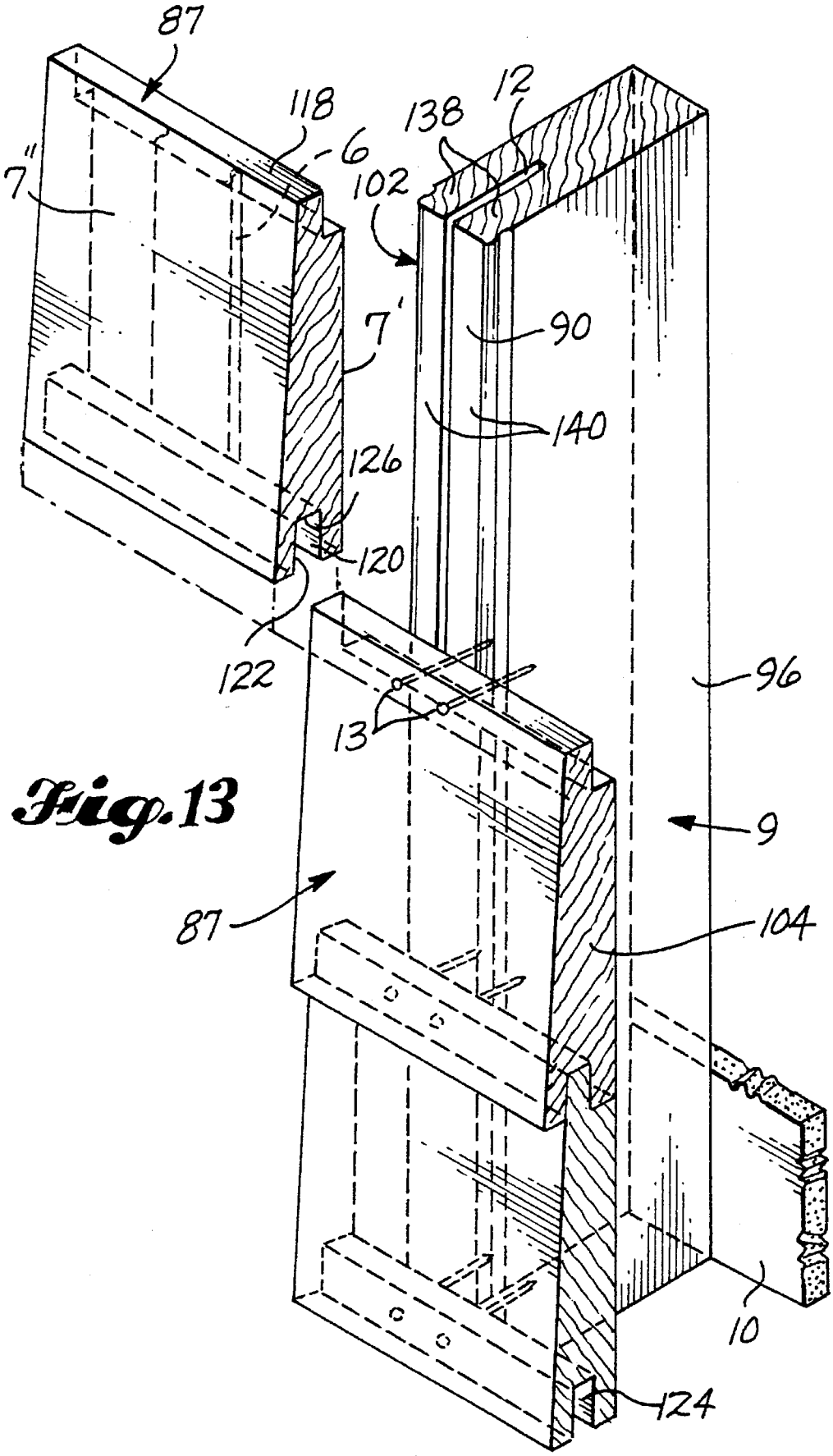
FIG. 13 is a partially exploded, part perspective view of the segment of the drywall-sheathed wall panel seen in FIG. 12 from a perspective that is ninety degrees removed from that of FIG. 12.
Figure 14:
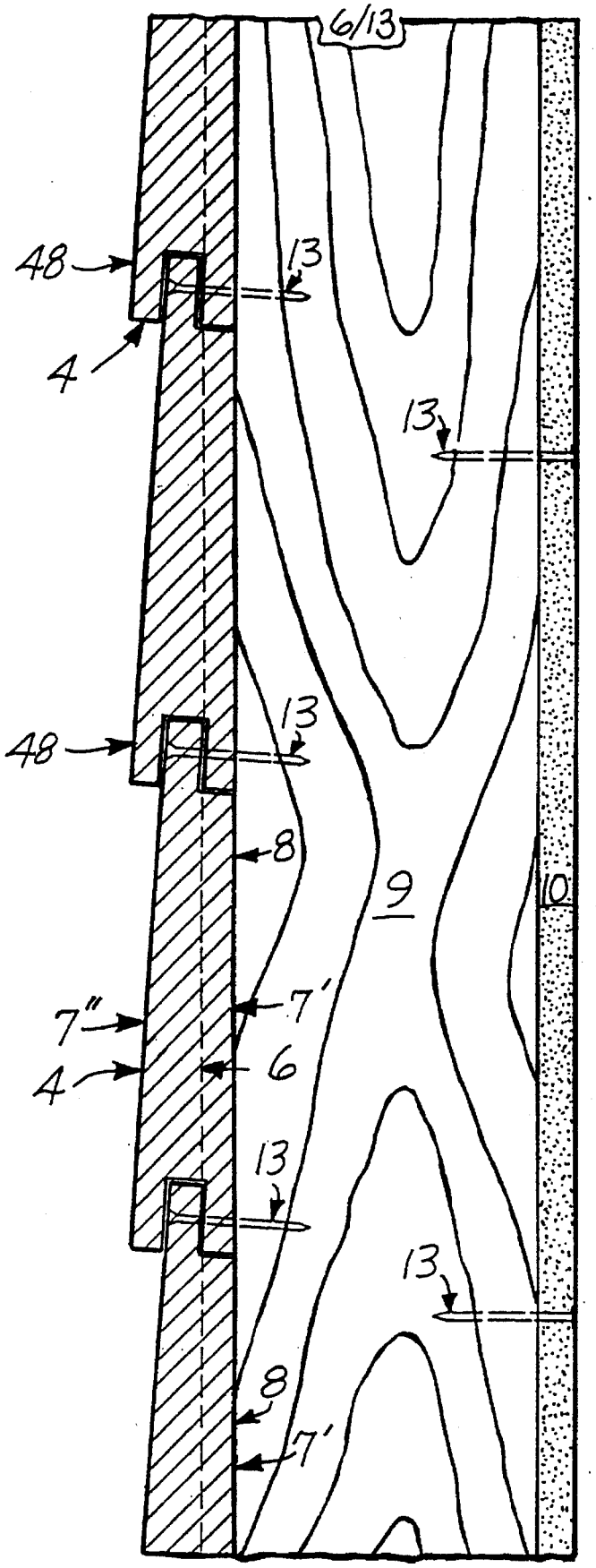
FIG. 14 is a part cross sectional view of the wall panel segment seen in FIGS. 12 and 13, taken in a vertical plane traversing the panel between framing members of the frame.

In making beveled sheet metal clad pieces of facing material for covering the frame, I once again select planks 168 (FIGS. 1 and 2) of partially dried wood having axes 170 extending longitudinally thereof, peripheral outlines 172 about the axes 170 thereof, and generally quadrilateral cross sections transverse the axes 170 which define pairs of mutually opposing sides 174 and edges 176 and corners 178 therebetween at the outlines 172 of the planks. In this instance, however, the edges 176 of the planks 168 have pairs of spaced parallel grooves 180 therein that extend along parallels to the axes 170 of the planks and cooperate with the sides 174 of the planks in defining longitudinally extending tongues 182 on the outlines 172 of the planks at the corners 178 thereof, and cooperate with one another in defining longitudinally extending lands 3 in the spaces therebetween at the edges 176 of the planks. Additionally, due to the partially dried condition thereof, the planks 168 have cores 1 of relatively moisture-laden heartwood extending longitudinally thereof at the axes 170 of the planks, and sheaths 2 of relatively dry peripheral wood extending longitudinally thereof about the heartwood cores 1 thereof but within the outlines 172 of the planks. In the process, I superimpose pairs of elongated strips 4 of sheet metal on the mutually opposing sides 174 of the planks so that the strips extend lengthwise along parallels to the axes 170 of the planks, and I wrap the longitudinally extending edge portions 184 of the strips 4 of sheet metal about the corners 178 of the planks to enclose the corners in sheet metal. I also secure the strips 4 to the tongues 182 of the planks while the strips are drawn taunt therebetween, as I shall explain; and then I subdivide the planks in planes 5 which extend through the heartwood cores 1 thereof along parallels to the axes 170 of the planks, and intersect the bottoms of those diagonally opposing grooves 180 in the mutually opposing edges 176 of the planks which are relatively adjacent the mutually opposing sides 174 thereof. This has the effect of forming pairs of elongated sheet metal clad boards 48 of wood having pairs of longitudinally extending rabbets 186 and grooves 180 in the mutually opposing edges thereof, and the mutually opposing relatively inwardly oriented sides 7' of which are inclined at acute angles to the sheet metal clad sides 174 of the boards and are subject to shrinkage along parallels to the plane 5 of subdivision between the boards when the boards are relatively separated from one another at the plane to expose the moisture-laden heartwood 1 of the respective boards to drying at the inclined operatively inwardly oriented sides 7' thereof. To secure the strips 4 to the tongues 182 of the planks, the longitudinally extending edge portions 184 of the strips are not only wrapped about the corners 178 of the planks, but the are also inserted in the grooves 180 disposed relatively adjacent the respective sides 174 of the planks; and more particularly, they are applied to the insides of the tongues 182 at those walls 188 of the grooves 180 which are disposed relatively adjacent the sides 174 of the planks.

What I claim my invention is:

1. A structural panel having opposing sides and an interior body plane between the sides thereof, said panel comprising:

a plurality of elongated framing members and a plurality of elongated pieces of facing material, said framing members having longitudinally extending axes, first longitudinally extending edges generally parallel to the axes thereof, and mutually opposing sides which extend generally parallel to the axes of the respective framing members transverse the first longitudinally extending edges thereof, said sides and said first longitudinally extending edges of the respective framing members coterminating with one another to form pairs of corners therebetween and to define first longitudinally extending edge portions of the respective framing members between the respective pairs of corners thereof, said framing members being arranged in spaced parallel relationship to one another, with the respective first longitudinally extending edges thereof disposed substantially in the body plane of the panel, to form a frame for the panel at one side thereof, said pieces of facing material having longitudinally extending axes, peripheral outlines about the respective axes thereof, and generally polygonal cross sections defining the peripheral outlines of the respective pieces of facing material in planes transverse the respective axes thereof, the cross sections of the respective pieces of facing material defining at the respective peripheral outlines thereof, a pair of mutually opposing first and second sides, a pair of mutually opposing first and second edges, and corners interposed between the respective pairs of first and second sides and edges of the pieces of facing material, said pieces of facing material being juxtaposed to one another in the body plane of the panel, with the respective first sides of the pieces of facing material oriented relatively toward the frame at the one side of the panel, and with the respective first and second edges of adjacent pieces of facing material abutted against one another to form a butt joint therebetween, said pieces of facing material having first grooves in the respective first sides thereof, which extend crosswise the longitudinally extending axes of the respective pieces of facing material, said first longitudinally extending edges of the framing members having grooves therein which extend longitudinally of the respective framing members to subdivide the respective first longitudinally extending edge portions thereof into at least pairs of longitudinally extending edge sections which are adapted to be resiliently deflected relatively toward one another transverse the axes of the respective framing members when a pincer effect is applied to the respective first longitudinally extending edge portions of the framing members at the respective pairs of corners corresponding thereto, and said first grooves in the respective first sides of the pieces of facing material and said first longitudinally extending edge portions of the framing members having cooperatively engaged means therein and thereon, respectively, whereby through driving the respective pieces of facing material into engagement with the respective framing members along angles to the body plane of the panel in the direction of the one side of the panel when the respective first grooves are in registry with the respective first longitudinally extending edges of the framing members, to thereby apply a pincer effect to the respective first longitudinally extending edge portions of the respective framing members and in turn resiliently deflect the pairs of longitudinally extending edge sections of the respective longitudinally extending edge portions of the framing members relatively toward one another as the respective first grooves in the pieces of facing material straddle the pairs of corners corresponding to the respective longitudinally extending edge portions of the framing members, the first grooves of the respective pieces of facing material are so engaged about the first longitudinally extending edge portions of the respective framing members at the respective pairs of corners corresponding thereto, as to releaseably interlock the respective pieces of facing material and the respective framing members against relative movement crosswise the body plane of the panel.

2. The structural panel according to claim 1 wherein the first grooves in the respective first sides of the pieces of facing material have mutually opposing sidewalls therein, and the means releaseably interlocking the respective pieces of facing material and the respective framing members are formed on the sidewalls of the respective first grooves of the respective pieces of facing material, and on the sides of the respective framing members at sites adjacent the pairs of corners corresponding to the respective first longitudinally extending edge portions thereof.

3. The structural panel according to claim 2 wherein the means releaseably interlocking the respective pieces of facing material and the respective framing members take the form of mutually opposing lips on the sidewalls of the respective first grooves in the respective first sides of the pieces of facing material, and mutually opposing recesses at the aforesaid sites in the sides of the respective framing members, having the lips cooperatively engaged therein.

4. The structural panel according to claim 2 wherein the first grooves in the respective first sides of the pieces of facing material have bottoms between the respective sidewalls thereof, and the bottoms of the respective first grooves have ribs upstanding thereon which extend transverse the longitudinally extending axes of the respective pieces of facing material and are engaged in the grooves in the first longitudinally extending edges of the framing members corresponding thereto.

5. The structural panel according to claim 1 wherein the respective pairs of first and second sides and edges of the pieces of facing material define first and second edge portions of the respective pieces of facing material at the respective pairs of corners interposed therebetween, and the structural panel further comprises means fastening the respective first edge portions of the respective pieces of facing material to the respective framing members at the first longitudinally extending edge portions thereof.

6. The structural panel according to claim 1 wherein the respective pairs of first and second sides and edges of the pieces of facing material define first and second edge portions of the respective pieces of facing material at the respective pairs of corners interposed therebetween, the first edge portion of one of the pieces of facing material has a first rabbet therein which extends along a parallel to the longitudinally extending axis of the one piece of facing material at the corner thereof interposed between the first side of the one piece of facing material and the first edge thereof, to form a projecting tongue on the first edge of the one piece of facing material between the first rabbet and the second side of the one piece of facing material, a second piece of facing material adjacent the one piece of facing material at the first edge of the one piece, having a second groove therein which extends along a parallel to the longitudinally extending axis of the second piece of facing material, and is engaged about the tongue on the first edge of the one piece of facing material to form a male/female joint between the respective pieces of facing material at the butt joint therebetween.

7. The structural panel according to claim 6 wherein the first grooves in the respective first sides of the pieces of facing material have mutually opposing sidewalls therein, and bottoms therebetween, and the tongue on the first edge of the one piece of facing material has a surface thereon which extends along a parallel to the longitudinally extending axis of the one piece of facing material in coplanar relationship with the bottoms of the first grooves in the respective first side thereof, and wherein the surface of the tongue and the bottoms of the first grooves in the respective first side of the one piece of facing material are abutted against the first longitudinally extending edges of the respective framing members.

8. The structural panel according to claim 6 wherein the tongue is fastened to the respective framing members at the first longitudinally extending edge portions thereof.

9. The structural panel according to claim 6 wherein the first edge portion of the one piece of facing material also has a second rabbet therein which extends along a parallel to the longitudinally extending axis of the one piece of facing material at the corner thereof interposed between the second side of the one piece of facing material and the first edge thereof, so that the tongue is spaced apart from the first and second sides of the one piece of facing material.

10. The structural panel according to claim 1 wherein the respective first sides of the pieces of facing material are inclined at acute angles to the respective second sides of the pieces of facing material, and vice versa, in directions relatively toward the first edges of the respective pieces of facing material.

11. The structural panel according to claim 1 wherein the facing material is wood material.

12. The structural panel according to claim 1 wherein the framing members take the form of elongated boards of wood.

13. The structural panel according to claim 1 further comprising elongated strips of sheet metal material having longitudinally extending axes, and longitudinally extending edge portions parallel thereto, and wherein the strips of sheet metal material are superimposed on the second sides of the respective pieces of facing material so that the longitudinally extending axes of the strips extend along parallels to the longitudinally extending axes of the respective pieces of facing material and the respective edge portions of the respective strips are wrapped about the corners of the respective pieces of facing material interposed between the second sides of the pieces of facing material and the respective first and second edges thereof, to enclose the second sides and said corners of the respective pieces of facing material in sheet metal.

14. The structural panel according to claim 1 further comprising bodies of thermal insulation material interposed in the spaces between pairs of the respective framing members.

15. A method of covering a structural frame comprised of elongated framing members arranged in spaced parallel relationship to one another, with first longitudinally extending edges thereof disposed in a plane, and mutually opposing sides thereof extending generally transverse the first longitudinally extending edges thereof and coterminating with the respective first longitudinally extending edges thereof to form pairs of corners therebetween and to define first longitudinally extending edge portions of the respective framing members between the respective pairs of corners thereof, comprising:

forming grooves in the first longitudinally extending edges of the framing members, which extend longitudinally of the respective framing members to subdivide the respective first longitudinally extending edge portions thereof into at least pairs of longitudinally extending edge sections which are adapted to be resiliently deflected relatively toward one another transverse the longitudinally extending axes of the respective framing members when a pincer effect is applied to the respective first longitudinally extending edge portions of the framing members at the respective pairs of corners corresponding thereto, and driving first one elongated piece of facing material into engagement with the respective framing members, and then a second piece of elongated facing material into engagement with the respective framing members, so that the respective pieces of facing material are juxtaposed to one another in the aforesaid plane with corresponding first sides of the pieces of facing material oriented relatively toward the frame and the respective pieces of facing material abutted against one another at adjacent edges thereof to form a butt joint therebetween, the pieces of facing material having first grooves in the respective first sides thereof which extend crosswise the longitudinally extending axes of the respective pieces of facing material and are arranged in registry with the respective first longitudinally extending edges of the framing members, and the respective pieces of facing material being driven into engagement with the respective framing members along angles to the plane and in the direction of the frame so as to apply a pincer effect to the respective first longitudinally extending edge portions of the respective framing members when the first grooves in the first sides of the respective pieces of facing material engage about the first longitudinally extending edge portions of the respective framing members at the respective pairs of corners corresponding thereto, and the first grooves in the first sides of the respective pieces of facing material and the first longitudinally extending edge portions of the framing members having means therein and thereon, respectively, which cooperatively engage one another when the longitudinally extending edge sections of the respective first longitudinally extending edge portions of the framing members resiliently deflect relatively toward one another as the respective first grooves in the pieces of facing material straddle the pairs of corners corresponding to the respective first longitudinally extending edge portions of the framing members, to releaseably interlock the respective pieces of facing material and the respective framing members against relative movement crosswise the plane.

16. The method according to claim 15 wherein the respective pieces of facing material have mutually opposing first and second edges transverse the respective first sides thereof, and the method further comprises fastening that portion of the one piece of facing material which is disposed at the first edge thereof, to the respective framing members at the respective first longitudinally extending edges thereof, before the second piece of facing material is driven into engagement with the respective framing members and the second edge of the second piece of facing material is abutted against the first edge of the one piece of facing material to form a butt joint therebetween.

17. The method according to claim 15 wherein the respective pieces of facing material have mutually opposing first and second edges transverse the respective first sides thereof, first corners interposed between the respective first edges thereof and the respective first sides thereof, rabbets in the first edges thereof which extend along parallels to the longitudinally extending axes of the respective pieces of facing material at the respective first corners thereof, to form projecting tongues on the first edges of the respective pieces of facing material between the rabbets and second sides of the respective pieces of facing material opposed to the first sides thereof, and second grooves in the respective second edges thereof which extend along parallels to the longitudinally extending axes of the respective pieces of facing material, and wherein after the one piece of facing material is driven into engagement with the respective framing members and the respective first grooves in the first sides of the one piece of facing material are engaged about the respective first longitudinally extending edge portions of the respective framing members, the second piece of facing material is driven into engagement with the respective framing members so that the second groove in the second edge of the second piece of facing material is engaged about the tongue on the first edge of the one piece of facing material to form a male/female joint between the respective pieces of facing material at the butt joint therebetween, the surfaces of the rabbets in the first edges of the respective pieces of facing material, which are oriented toward the frame, being coplanar with the bottoms of the first grooves in the first sides of the respective pieces of facing material, so that the respective surfaces of the rabbets and the bottoms of the first grooves abut the first longitudinally extending edges of the respective framing members when the respective pieces of facing material are driven into engagement with the respective framing members and the second groove in the second edge of the second piece of facing material engages about the tongue on the first edge of the one piece of facing material.

18. The method according to claim 17 further comprising driving fasteners through the tongue on the first edge of the one piece of facing material and into the first longitudinally extending edge portions of the respective framing members before the second piece of facing material is driven into engagement with the respective framing members and the second groove in the second edge of the second piece of facing material is engaged about the tongue on the first edge of the one piece of facing material.

19. A framing member for forming a structural frame, said framing member comprising:

an elongated board of wood having a longitudinally extending axis, pairs of mutually opposing sides and first and second edges extending along parallels to the longitudinally extending axis of the board of wood, and coterminating with one another to form pairs of corners therebetween and to define mutually opposing first and second longitudinally extending edge portions of the board of wood between the respective pairs of corners corresponding thereto, said first edge of the board of wood having a groove therein which extends along a parallel to the longitudinally extending axis of the board of wood, to subdivide the first longitudinally extending edge portion of the board of wood into at least a pair of longitudinally extending edge sections which are adapted to be resiliently deflected relatively toward one another transverse the longitudinally extending axis of the board when a pincer effect is applied to the first longitudinally extending edge portion of the board at the pair of corners corresponding thereto, said pair of corners corresponding to the first longitudinally extending edge portion of the board of wood having convexly rounded surfaces thereon coterminating with said first edge, and extending in spaced, parallel relationship to one another, and said sides of the board of wood having mutually opposing recesses therein which extend along parallels to the longitudinally extending axis of the board of wood on the opposite side of the convexly rounded surfaces of the pair of corners corresponding to the first longitudinally extending edge portion of the board, from said first edge of the board, to cooperate with releasable interlock means in a groove of a facing material applied to the first longitudinally extending edge portion of the board to generate the aforesaid pincer effect therein.

20. The framing member according to claim 19 further comprising an elongated bead of caulking material interposed in the groove between the edge sections of the first longitudinally extending edge portion of the board of wood.

21. A kit for assembling the body of a structural panel having opposing sides and a body plane therebetween, said kit comprising:

a plurality of elongated framing members and a plurality of elongated pieces of facing material, said framing members having longitudinally extending axes, first longitudinally extending edges generally parallel to the longitudinally extending axes thereof, and mutually opposing sides which extend generally parallel to the axes of the respective framing members transverse the first longitudinally extending edges thereof, said sides and said first longitudinally extending edges of the respective framing members coterminating with one another to form pairs of corners therebetween and to define first longitudinally extending edge portions of the respective framing members between the respective pairs of corners thereof, said pieces of facing material having longitudinally extending axes, peripheral outlines about the respective axes thereof, and generally polygonal cross sections defining the peripheral outlines of the respective pieces of facing material in planes transverse the respective axes thereof, the cross sections of the respective pieces of facing material defining at the respective peripheral outlines thereof, a pair of mutually opposing first and second sides, a pair of mutually opposing first and second edges, and corners interposed between the respective pairs of first and second sides and edges of the pieces of facing material, said pieces of facing material having first grooves in the respective first sides thereof, which extend crosswise the longitudinally extending axes of the respective pieces of facing material, said first longitudinally extending edges of the framing members having grooves therein which extend longitudinally of the respective framing members to subdivide the respective first longitudinally extending edge portions thereof into at least pairs of longitudinally extending edge sections which are adapted to be resiliently deflected relatively toward one another transverse the axes of the respective framing members when a pincer effect is applied to the respective first longitudinally extending edge portions of the framing members at the respective pairs of corners corresponding thereto, said sides of the respective framing members having mutually opposing recesses therein which extend along parallels to the longitudinally extending axes of the respective framing members at sites adjacent the corners of the first longitudinally extending edge portions of the respective framing members, said first grooves in the respective first sides of the pieces of facing material having mutually opposing sidewalls therein, bottoms interposed therebetween, and mutually opposing relatively inturned lips on the sidewalls of the respective first grooves which extend transverse the longitudinally extending axes of the respective pieces of facing material, said first grooves in the first sides of the respective pieces of facing material being adapted to engage about the corners of the first longitudinally extending edge portions of the respective framing members when the respective framing members are arranged in spaced parallel coplanar array with one another to register with the first grooves in the first sides of the pieces of facing material, and the pieces of facing material are driven into engagement with the array of framing members at the first longitudinally extending edge portions thereof, and at angles to the plane thereof, and said pairs of lips in the first grooves in the first sides of the respective pieces of facing material being adapted to releaseably engage in the recesses in the sides of the respective framing members, to releaseably interlock the pieces of facing material with the array of framing members, and vice versa, when the first grooves in the first sides of the pieces of facing material are engaged about the first longitudinally extending edge portions of the respective framing members.

22. The kit according to claim 21 wherein the second edges of the respective pieces of facing material have second grooves therein which extend along parallels to the longitudinally extending axes of the respective pieces of facing material, and the first edges of the respective pieces of facing material have rabbets therein which extend along parallels to the longitudinally extending axes of the respective pieces of facing material at the corners thereof interposed between the first edges and the first sides of the respective pieces of facing material, to form projecting tongues on the first edges of the respective pieces of facing material between the respective rabbets and the respective second sides of the respective pieces of facing material, and wherein the tongues on the first edges of the respective pieces of facing material are engageable in the second grooves in the second edges of the respective pieces of facing material, to form male/female joints between the respective pieces of facing material when the respective pieces of facing material are abutted against one another at the respective edges thereof.

* * * * *